United States Patent [19]

Mallory

[11] Patent Number: 4,581,606

[45] Date of Patent: Apr. 8, 1986

[54] CENTRAL MONITOR FOR HOME SECURITY SYSTEM

[75] Inventor: John Mallory, Mississauga, Canada

[73] Assignee: Isotec Industries Limited, Toronto, Canada

[21] Appl. No.: 412,514

[22] Filed: Aug. 30, 1982

[51] Int. Cl.[4] ..... G08B 1/08; G08B 26/00

[52] U.S. Cl. ..... 340/539; 340/506; 340/505; 340/518

[58] Field of Search ..... 340/539, 506, 531–538, 340/521, 825.22, 825.27, 825.34, 825.36, 825.5, 825.44, 825.49, 517, 525, 518, 505; 179/5 R, 5 P; 364/550

[56] References Cited

U.S. PATENT DOCUMENTS

| | | | |
|---|---|---|---|
| 3,914,692 | 10/1975 | Seaborn, Jr. | 340/539 |
| 3,925,763 | 12/1975 | Wadhwani et al. | 340/539 |
| 4,095,220 | 6/1978 | Sadler | 340/517 |
| 4,191,948 | 3/1980 | Stockdale | 340/539 |
| 4,204,201 | 5/1980 | Williams et al. | 340/521 |
| 4,375,637 | 3/1983 | Desjardins | 340/531 |
| 4,422,071 | 12/1983 | de Graaf | 340/825.44 |
| 4,465,904 | 8/1984 | Gottsegen et al. | 340/518 |

OTHER PUBLICATIONS

ADEMCO publication, "Eight Channel Digital Communicator", pp. D5–D6, 6/21/85.

*Primary Examiner*—Donnie L. Crosland
*Attorney, Agent, or Firm*—Sim & McBurney

[57] ABSTRACT

A security alarm system has a plurality of sensors for fire, smoke, intrusion and appliance operation. A central monitor is provided for monitoring and perceptibly indicating the status of each of the sensors. To provide for communication between the sensors and the central monitoring system, transmitters are located on the sensors and a receiver is provided on the central monitor. When one of the sensors establishes an alarm condition, its transmitter is actuated to transmit information indicating the type of alarm. A portable keyboard loads information data into an electronic memory of each of the transmitters and into the electronic memory associated with the receiver. The keyboard is separable from each memory to preclude altering of the information stored in the electronic memory of the respective transmitter. The receiver identifies data transmitted from a particular transmitter by accessing its memory which is loaded with the data from the keyboard, and obtaining a match of the data transmitted to the data stored to identify the sensor. The central monitor then indicates the appropriate alarm based on the identified transmitter of a particular sensor.

9 Claims, 12 Drawing Figures

1 2 3 4 5 6 7 8 9 10 11 12 13 14 15 16 17 18 19 20 21 22 23 24 25
SYSTEM I.D. #
SENSOR DESCRIPTION
SENSOR LOCATION INDEX
SENSOR LOCATION SUB-INDEX
SENSOR STATUS
FLAG
0 1 1 1 1 1 1 0
0 0 0 0 0 0 1 1 0 0 0 1 0 0 0 0 0 1 0 0 0 0 0

CENTRAL MONITOR FOR HOME SECURITY SYSTEM

FIELD OF THE INVENTION

This invention relates to security alarm systems which including monitoring alarms for fire, smoke, intrusion, appliance operation and the like.

BACKGROUND OF THE INVENTION

Security alarm systems are becoming increasingly popular in residential communities. The most common form of sensor in residential areas and homes is the form of fire and smoke detector. However, there has been increased use in residential areas of intrusion or burglar alarms and also devices which monitor the status of various appliances in the home, whether it be a gas-fired water heater, gas-fired furnace, freezers and the like. Similar alarm systems are, of course, used in industry. As the systems are expanded at each installation, it becomes more and more important to have a central monitoring device which determines the status of all of the sensors to ensure that they are operative at all times and which is to be located in an area such that, when an alarm is sounded, the type of alarm and its whereabouts can be determined.

This has resulted in the demand for a central monitor which can communicate with all forms of sensors in a home or industrial installation. To accomplish this objective, transmitters have been devised for coupling with the various sensors and transmitting information to a receiver of a central monitor system. The information transmitted may identify the type of alarm and its location. In industrial applications, radio transmitters are not frequently used, because it is easy to install wiring to hook up the various sensors directly with the central monitor system. However in the home, wiring is unattractive and with the use of radio receivers and transmitters, the wiring is eliminated.

In residential applications, it is important to distinguish the security alarm system of one household relative to all adjacent households. This prevents a transmitter in one household transmitting an alarm condition and having it picked up by the neighbouring household alarm system. To avoid this, each transmitter is coded with information, which not only identifies the particular alarm system, but also the sensor which is transmitting the alarm. This requires that some form of memory be provided with each transmitter and with the receiver. Presently this has been accomplished by use of a memory which is precoded before the unit is sold, offering little flexibility to the householder or by use of memories which may be coded by mechanically flipping switches. By using a predetermined format, the code for the system can be entered into the device by flipping the appropriate switches along with a code for the particular sensor being coupled with a transmitter. Such preprogramed or limited mechanical switching program memories offer little flexibility and to the average consumer are difficult to program. Since the program is provided by way of switches, they can be accidentally altered or could be intentionally altered by an intruder into a household. In addition, the transmitters normally have their own power supply which is separate from the sensor. It usually involves locating the transmitter outside of the sensor, adding to the bulkiness of the overall system and detracting from the attractiveness of the various sensors which are visible, such as the smoke and perhaps the intrusion detectors.

The improvements in security systems, according to this invention, overcome the above problems in providing a far more flexible system to accommodate variations of each household and which can be readily installed by the consumer.

SUMMARY OF THE INVENTION

In most security alarm systems, there are a plurality of sensors for one or more of fire, smoke, intrusion, appliance operation and the like. A central monitor device monitors and is capable of perceptibly indicating the status of each of the sensors. Individual transmitters are provided for each of the sensors for transmitting information from a respective sensor to a receiver associated with the central monitor. The central monitor processes the transmitted information to indicate perceptibly the status of the respective sensor causing transmission of the information. A memory is associated with each transmitter and with the receiver for storing information. This enables the monitor to recognize information transmitted by a respective transmitter of its system, as actuated by a corresponding sensor, to identify the status of the sensor. The improvement, according to this invention, comprises electronic means for loading information data into an electronic memory for each of the transmitters and into an electronic memory associated with the receiver. Each transmitter has electrical coupling means for electrically connecting the transmitter to the data loading means. The transmitter is separable from the data loading means after completion of loading the desired identification information data into the electronic memory. This precludes altering the information data stored in the electronic memory.

The data loading means may be a keyboard to facilitate manual entry of the predetermined information. The data loading means is adapted to process the information entered via the keyboard and convert it into data which is loaded into the respective electronic memory for the transmitter and the receiver. The data loading means may be a component of the monitor, where the monitor has an electrical coupler compatible with the electrical coupler of each transmitter to provide for electrical communication between the respective transmitter and the data loading means. In this instance, the data loading means may be adapted to load at the same time the information into both the respective transmitter memory and the memory associated with the receiver to avoid errors in loading information into the memories of the transmitter and receiver. This ensures that the proper information of the sensor is transmitted and recognized by the receiver of the monitor.

The transmitter then, for use in association with the security alarm system has a programmable electronic memory and an electrical coupling means for electrical connection to an electronic device for loading information into the programmable electronic memory.

To facilitate use of a transmitter with existing sensors, the transmitter is adapted for insertion between an electrical coupling to or terminals of a power supply for a corresponding alarm sensor and the power supply leads to the alarm sensor. The transmitter has means for sensing excessive power drawn by the alarm sensor when the alarm goes into an alarm state. The power sensing means activates the transmitter when there is an alarm, to indicate the alarm by transmitting the coded information in its memory for identifying itself to the central monitor.

The transmitter may be provided with a temporary power supply to power the electronic memory of the transmitter once disconnected from the data loading means until the transmitter is connected to the power supply of the alarm sensor. The transmitter includes an electrical connector device to permit connection with the means for loading the identification information data into the electronic memory of the transmitter and permit disconnection. The transmitter may also be equipped with a battery voltage sensor to determine when the battery voltage has dropped at steady state below a predetermined level. Such device actuates the transmitter to signal the central monitor that the power supply of the particular battery powered sensor is low to notify the need for battery replacement.

BRIEF DESCRIPTION OF THE DRAWINGS

Preferred embodiments of the invention are shown in the drawings, wherein.

Figure 7:
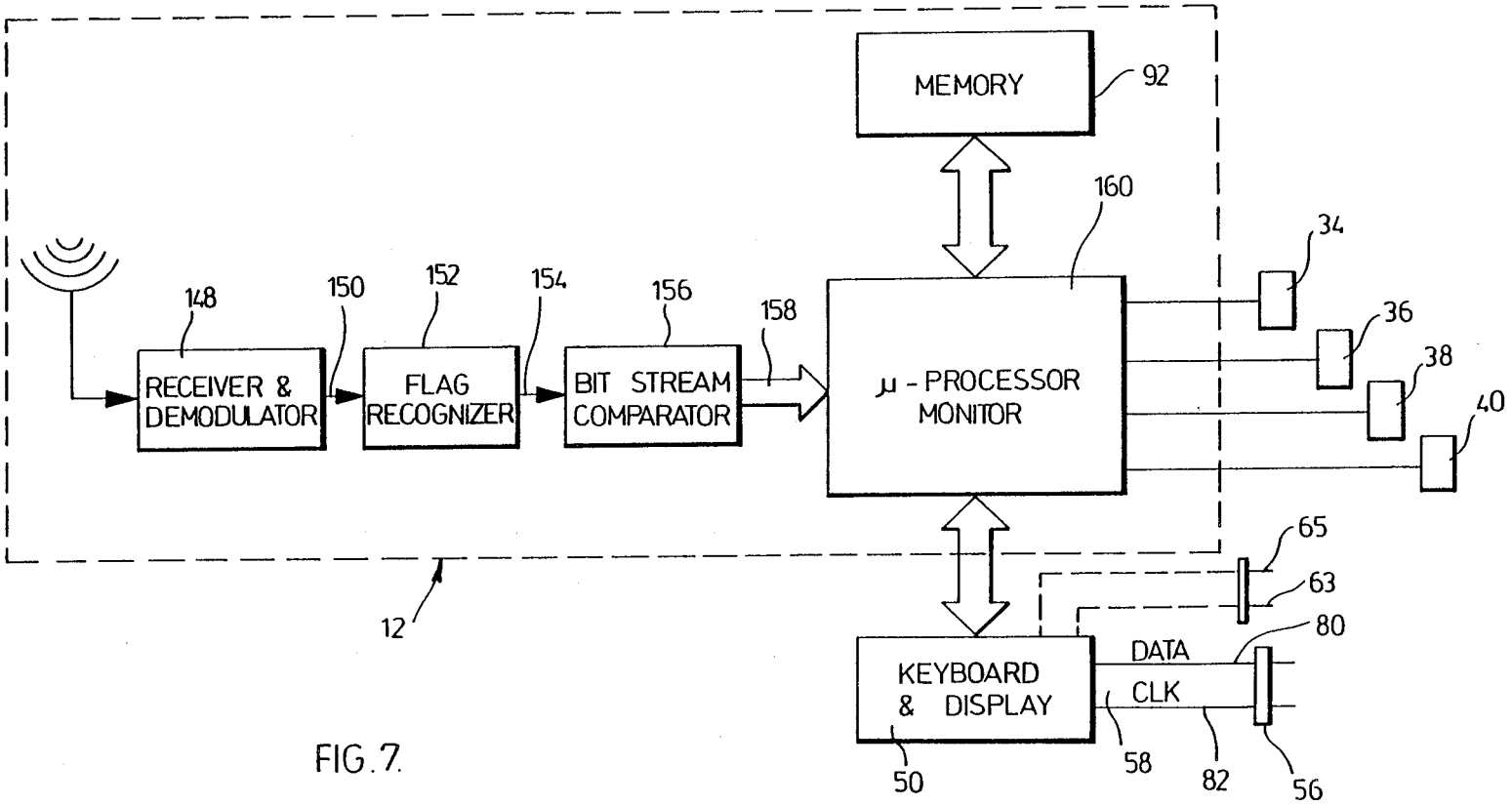

FIGS. *6a* through *6e* schematically represent the storage format in the memory of the transmitter and the string of output of data when the transmitter is activated;

FIG. 7 is a block diagram of the central monitor and receiver network; and

Figure 8:
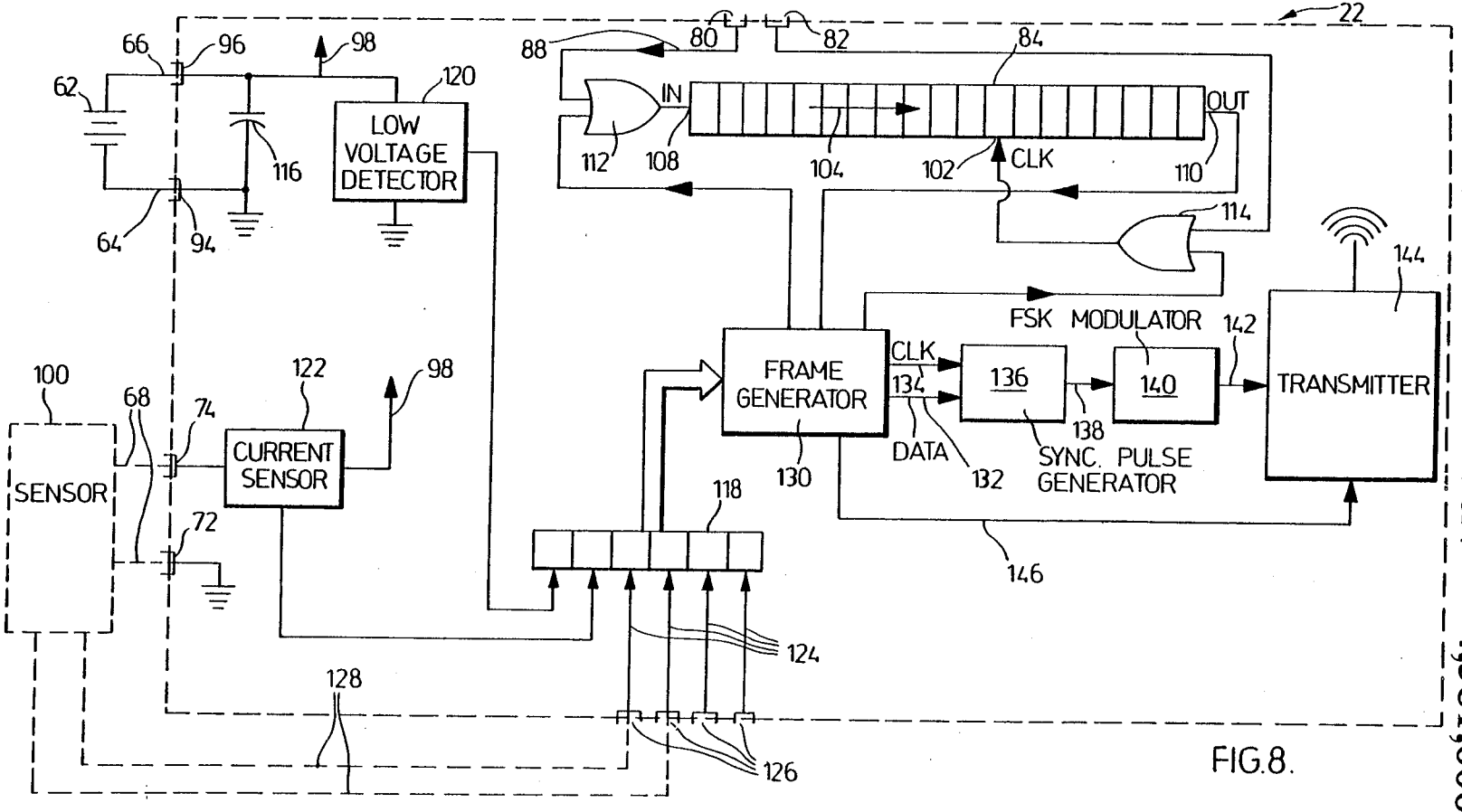

FIG. 8 is a block diagram of the transmitter.

DETAILED DESCRIPTION OF THE PREFERRED EMBODIMENTS

Figure 1:
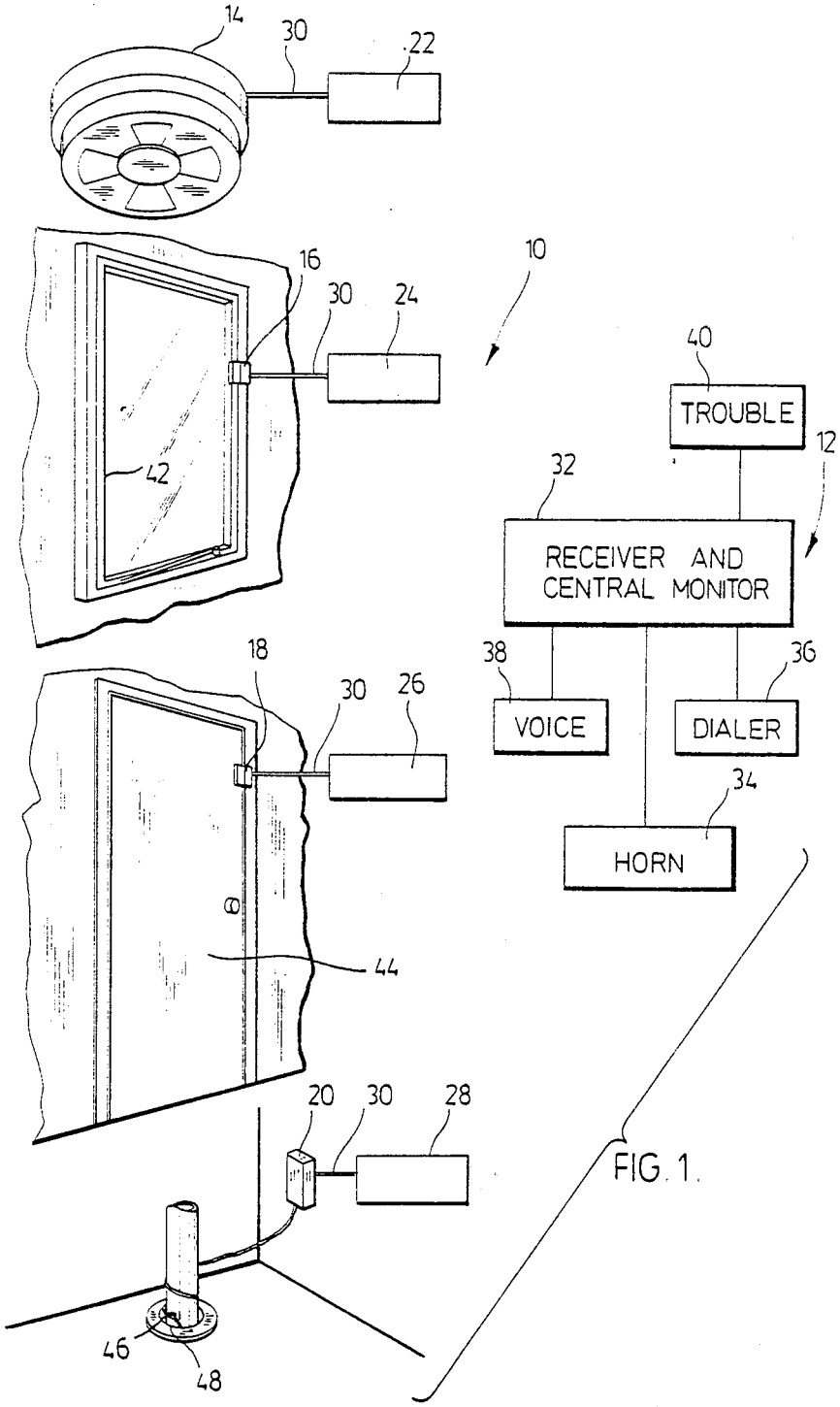
FIG. 1 is a schematical representation of a security alarm system having a plurality of sensors and a central monitoring system. A transmitter is associated with each sensor which is adapted to transmit information to a receiver of the central monitor system.

It is appreciated that there are many transmitter and receiver components available which may be operated by way of integrated circuit chips to provide compact units. FIG. 1, therefore, schematically represents the transmitter and receiver in the central monitor system where it is understood for sake of illustration that the transmitters are shown as large blocks. In FIG. 1, the security alarm system 10 comprises a central monitor 12 and a plurality of sensors 14, 16, 18 and 20. Each sensor is specific to fire, window entry, door entry and detection of high water level in a basement sump area. Obviously there are many other applications for sensor, particularly in the household, for sensing the status of appliances such as freezers and refrigerators and the supply of gas to gas-fired water heaters, to gas-fired furnaces and the like. Associated with each of the sensors is a specific transmitter 22, 24, 26 and 28.

For purpose of illustration, each transmitter is electrically connected to the sensor by way of electrical leads 30. The central monitor 12 includes a cabinet 32 which may include a visual display. The cabinet houses a receiver for the transmitters 22, 24, 26 and 28. The central monitor can actuate an outside horn 34, a telephone dialer 36, a voice synthesizer 38 and a trouble indicator 40. Sensor 14, upon sensing smoke in a room, actuates the transmitter 22 to signal the central monitor 12 and the appropriate alarm or call is made.

Similarly the opening of window 42 and door 44 are detected by contact switches to actuate the transmitters 24 and 26, where the signal as received by the central monitor actuates the appropriate alarm. With the detector leads 46 in the sump area 48, a high water level is detected to actuate sensor 20 and in turn cause the transmission from transmitter 28 to signal the central monitor and cause a trouble alarm at 40. Each of the transmitters 22, 24, 26 and 28 has an electronic memory which stores the particular coded information to identify the sensor that the transmitter is associated with and to provide a code which identifies the alarm system that the transmitter belongs to. As can be appreciated, the central monitor system must be able to recognize only its own transmitters and not those of some other building. Thus, each transmitter memory is loaded with a code to identify the system.

The particular format of the information stored in the electronic memory of each transmitter is illustrated in FIG. *6a*. Bits 1 through 7 are reserved for storing in Binary form the system identification number which uniquely identifies the central monitor system that the transmitter belongs to. The seven bits of information can uniquely identify up to 128 different systems and, therefore, with a judicious selection of a system identification number, interference from neighbouring systems will be eliminated.

Bits 8 through 19 are reserved for describing the type of sensor and its characteristics. In particular, bits 8 through 11 identify the description of the sensor such as sensors for fire, window or door entry, and high water level detection. Up to sixteen types of sensors can be described by the sensor description field. In a large building, it is desirable to have more than one of any particular type of sensor. For example, it may be desired to have a fire sensing device in each room of the house. Therfore, bit fields 12 through 15 and 16 through 19 are reserved for indexes and subindexes specifying the particular sensor's location. The sensor location index field may be used to uniquely identify up to sixteen locations in the systems purview. Each of these sixteen locations may be further broken down into another sixteen sub locations by the sensor location subindex field contained in bits 16 through 19. It will be appreciated that the sensor description codes and sensor location index and subindex codes may either be predetermined or assigned a specific meaning to be interpreted by the monitor at the time of loading the information into a particular transmitter memory.

Figure 2:
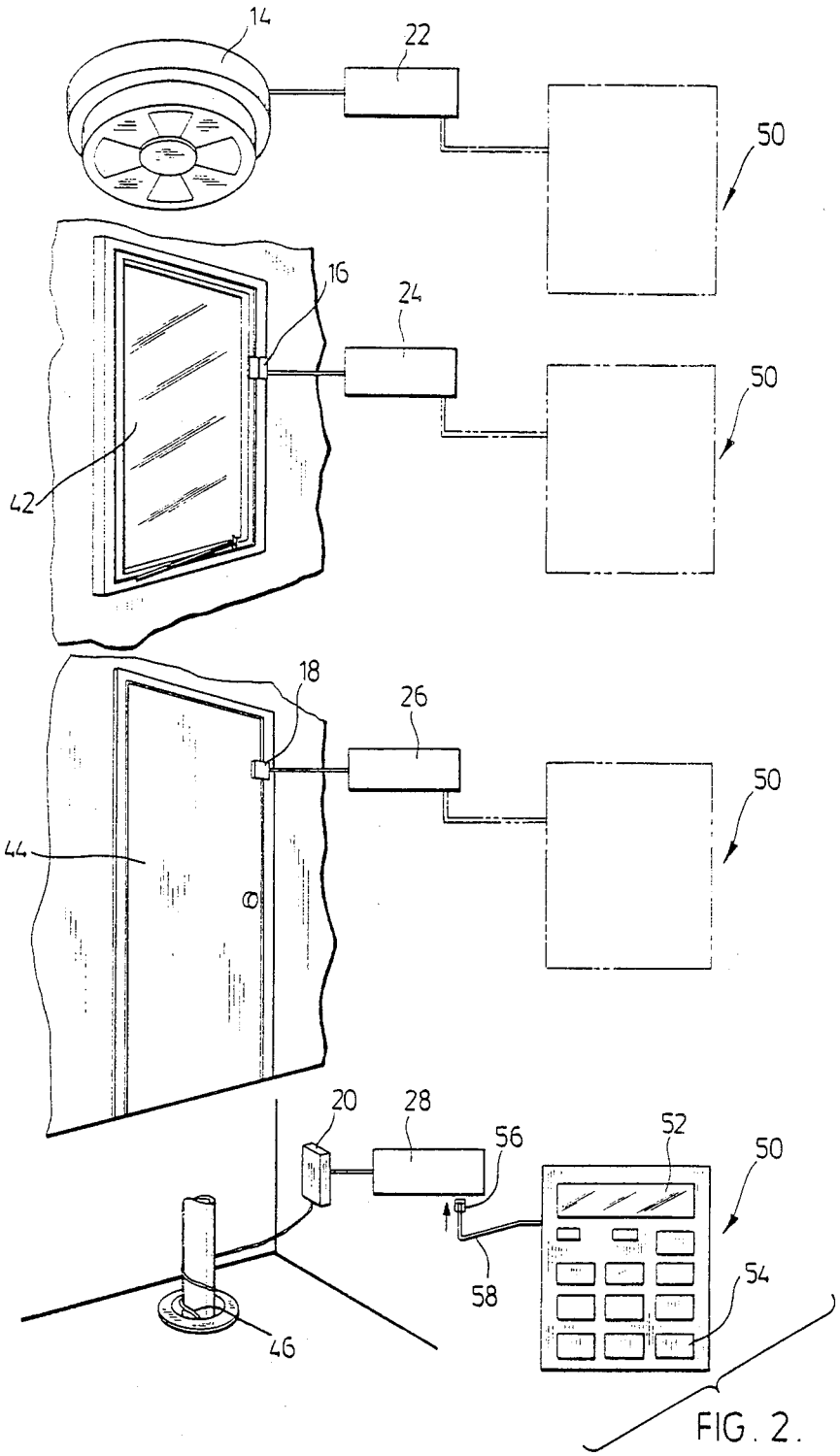
FIG. 2 is a schematical representation of the use of an electronic keyboard for loading identification coding information into the memory of the transmitter associated with each sensor.

In order to load the information into the transmitter, as shown in FIG. 2, a portable handheld keyboard 50 is used which has a visual display 52 and keys 54. The keyboard has an electrical coupling 56 at the end of its electrical lead 58, which is connectible to the transmitter 28. Information can be loaded into the memory of the transmitter 28 by pressing the appropriate keys of the keyboard 50. The keyboard 50 may include a microprocessor to process the information being entered on the keys and displayed at 52 to convert it into properly coded information which is storable in the memory of transmitter 28.

Figure 4:
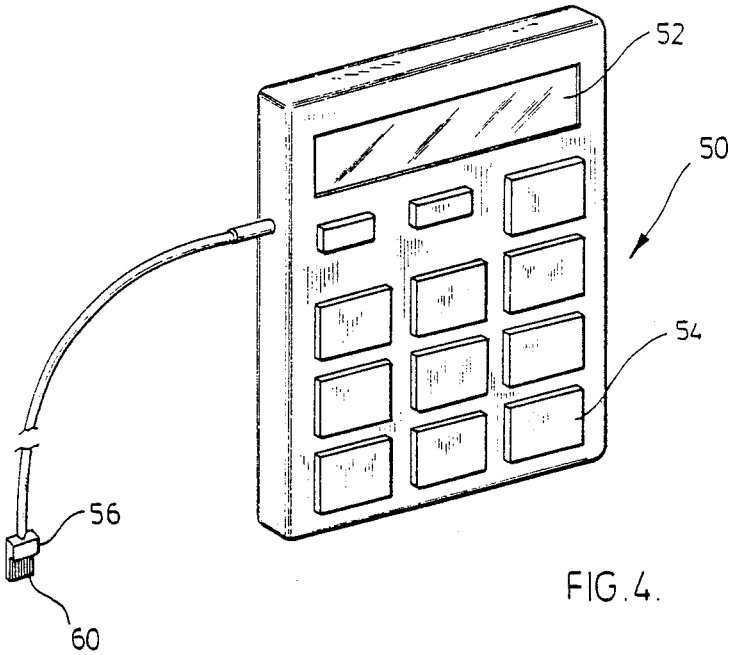
FIG. 4 is a perspective view of the keyboard.

FIG. 4 shows the keyboard 50 in greater detail with the electrical coupler 56 having metal prongs 60 which are adapted to fit in the approprate recepticle of the transmitter. FIG. 7 shows electrical lead 58 comprising two information carrying wires 80 amd 82. Wire 80 carries one of the bits of data that is to be loaded into the transmitter memory 84 of FIG. 8 and wire 82 carries a clock pulse for synchronization purposes. As can be seen in FIG. 8, the transmitter is equipped with a receptacle 80 to accept the electrical coupler 56. Data on line 80 is transferred to line 88 in the particular transmitter and the data on line 82 is transmitted to line 90 in the particular transmitter. The nineteen bits of information comprising the system identification number, sensor description, sensor location index and sensor location subindex are sequentially down loaded into the memory 84 of the transmitter. The keyboard 50 is disconnectible from the transmitter after the information is loaded into the memory of the transmitter. Thus the information coded in the transmitter cannot be altered unless it is recoupled with the keyboard 50. This prevents altering of the information loaded into the transmitter to avoid errors and mishaps and also to prevent intruders, such as burglars, modifying the program before an alarm can be sounded.

Figure 3:
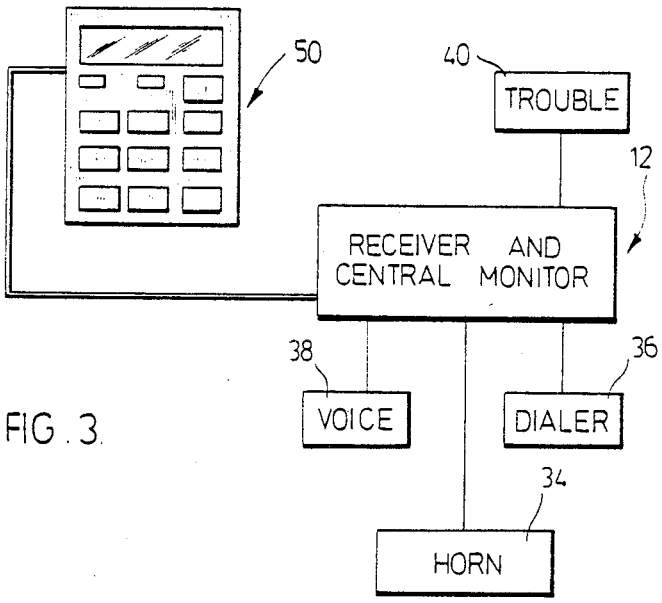
FIG. 3 is a schematical representation of the use of the keyboard of FIG. 2 for loading information into the memory associated with the receiver of the central monitoring system.

As suggested in FIG. 3, the keyboard 50 can in actual fact be an integral component of the central monitor system and remain with the central monitor. The central monitor can be provided with appropriate coupler to permit hook up of the transmitter which is to be loaded with information to the central receiver and then by use of the keyboard, load the necessary information into the respective transmitter.

If the keyboard is alpha-numeric, then the information to be entered on the keyboard may read as follows: "Smith" to identify the system identification number; "Water Sump" to identify the sensor description; "Furnace Room" to identify sensor location; and a sub-location means if so desired. The keyboard is adapted to process such information and convert it into data which is loaded into the corresponding memory 84. When the sensor leads 46 sense a high water level, the transmitter 28 is actuated to transmit this information. The receiver, upon receiving the initial code of the transmission, recognizes the transmitter 28 as one of its system and processes the transmitted information to actuate the trouble alarm 40. Simlarly with transmitters 22, 24, and 26, the keyboard 50, as shown in dot in each instance, may be used to load the appropriate information into the electronic memory of each of those transmitters.

It will be appreciated to those skilled in the art that many possibilities exist for the sequence and type of instructions accepted by the keyboard unit. It may be desirable to have a "high level" type of communication with the keyboard as previously discussed. That is to say, full textual descriptions of the system identification number, sensor description, sensor location index and sensor location subindex may be used. This type of coding is readily understood by the average consumer, however, as will be appreciated, leads to more complicated processing requirements in either the keyboard or central monitor than may be economical.

A less complex, but easy to use encoding system may be as follows. Any number between 1 and 128 may be used for the system identification number. For the sensor description, various codes may be preassigned, such as 1 for fire sensors, 2 for window entry sensor, and so on. Similarly, for the sensor location index, 1 may identify the basement, 2 may identify the attic and so on. The consumer would be left to attach a particular meaning to the sensor location subindex codes which may range from 1 through 16. The system identification number need only be entered once, if the keyboard is an integral component of the central monitor system. The microprocessor of the central monitor would be adapted to automatically load the system identification number into each transmitter memory when the transmitter is being loaded with data. In any event, when loading information into the memory of a particular transmitter, the sensor description, sensor location index and sensor location subindex codes must individually be specified. During loading of a particular transmitter's memory, the display on the keyboard prompts the user with the next code to be entered. After all the codes are entered the display on the keyboard responds with the codes entered and an opportunity for verification is afforded. The codes are then processed into the format illustrated in FIG. 6*a* and loaded into the memory 84 of the particular transmitter.

The central monitor system 12 must also have a memory 92 to hold associated information indicative of what has been loaded into the transmitters. The keyboard 50 is used to load into the central monitor system 12 all of the pieces of information identifying the various transmitters 22, 24, 26 and 28, along with the identification number for the system. If the keyboard is an integral component of the central monitor system, it will be appreciated that the memory 92 of the monitor system is loaded with the appropriate information simultaneously with the loading of the information into the memory 84 of a particular transmitter.

FIG. 8 shows, enclosed in dot, a transmitter such as transmitter 22. External to the transmitter is a power supply 62 which is connected through leads or terminals 64 and 66 to terminals 94 and 96 of the transmitter. Power internal to the transmitter is designated by numeral 98. Terminals 72 and 74 are provided on the transmitter to power a particular sensing device 100 through leads 68.

Figures 6A, 6B, 6C, 6D, 6E:
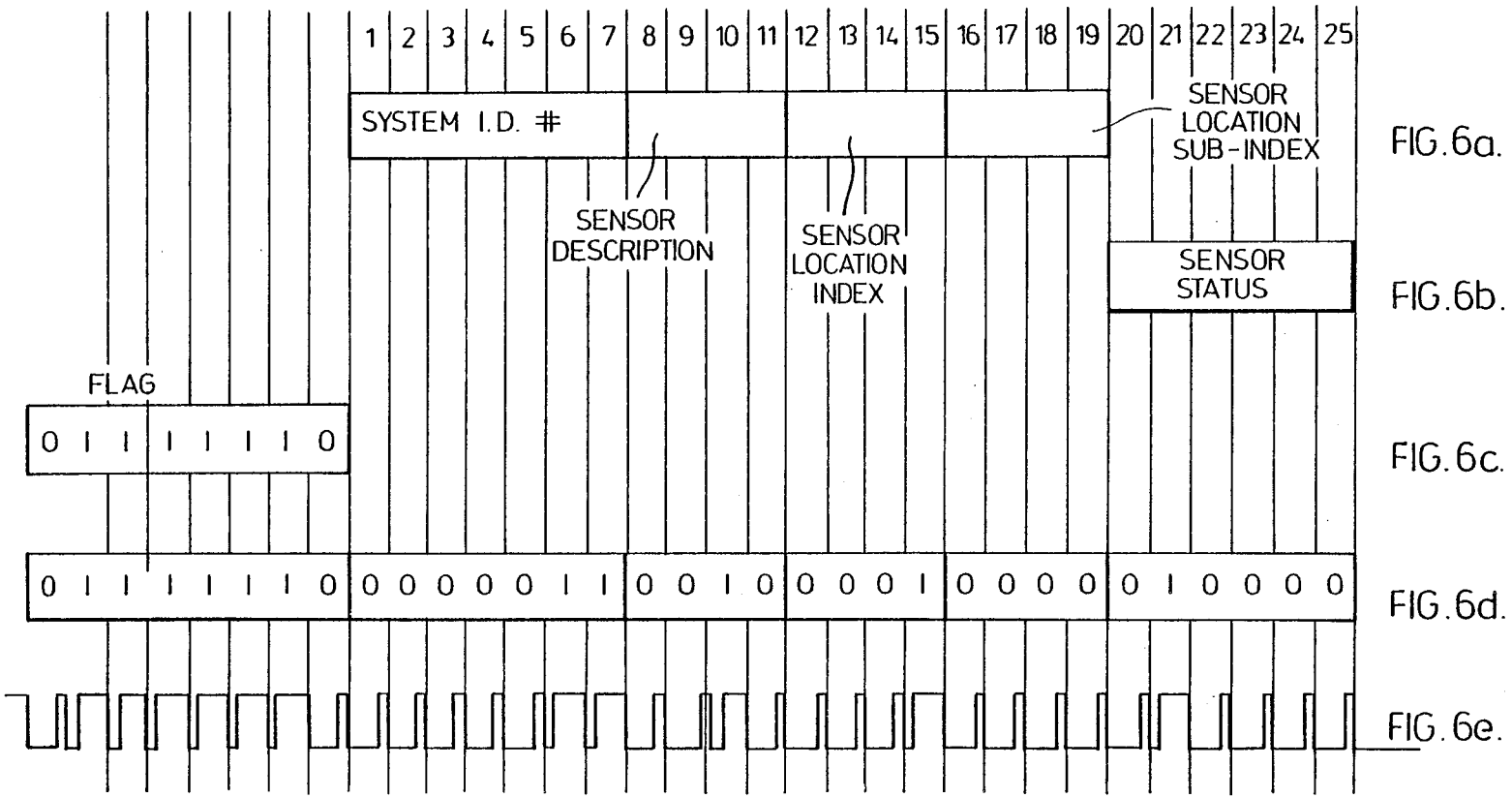

Memory 84, which has been previously discussed, is a shift register capable of holding 19 bits of information. A clock input 102 shifts data one position to the right as indicated by arrow 104 upon each clock pulse. A bit of data enters the shift register memory at 108 and exits at 110. As information is loaded into the memory 84 from the keyboard or central monitor, data enters on line 88 and synchronizing clock pulses enter on line 90. The information on lines 88 and 90 are OR'd through gates 112 and 114. Therefore, the binary string of information, as indicated in FIG. 6*a*, is sequentially clocked into memory 84. The electrical coupler 56 is then disconnected from connector 80 and thereafter the information stored in memory 84 is non-alterable.

After the coupler 56 is disconnected from connector 80, the transmitter is moved to its appropriate location and connected between power supply 62 and sensor 100. In situations where the transmitter is programmed away from the sensor power supply 62, the optional power supply leads 63, 65 from the keyboard 50 are coupled to the transmitter sockets 94 and 96 to power the transmitter while being programmed. When the programming is complete, the power leads 63, 65 are disconnected. A capacitor 116 of suffificient capacitance is connected across the power supply terminals in order to maintain sufficient voltage in the transmitter and in particular memory 84 so that it does not loose the information that has been loaded into it prior to connection of the transmitter to power supply 62.

A status register 118 is provided in the transmitter to hold 6 bits of information indicative of the status of the sensor. One bit of the status register is connected to a low voltage detector which indicates when power supply 62 is below a predetermined threshhold level. Another bit of the status register is connected to a current sensor 122. If sensor 100 is of a certain type, upon an alarm condition being detected, it will draw an amount of current above normal. Current sensor 122 is adapted to sense this increase in current drain and thereby detect an alarm condition in the sensor 100. The remaining four bits of status register 118 are connected through lines 124 to sockets 126 in the side of the transmitter. For a sensor 100 having outputs indicative of a particular status, lines 128 shown in dot, are connected to sockets 126 thereby transferring the information to the associated bits of the status register 118. The six bits of information of the status register 118 are shown in field format in FIG. *6b*.

Upon a status condition being sensed in status register 118, the information in the transmitter is transmitted. According to this embodiment, the information is transmitted at radio-wave frequency through air. It is understood, however, the information may also be transmitted through air by using other forms of electromagnetic radiation, such as ultra-sonic and infra-red. In addition, the signal may be transmitted through the existing household wiring. Theframe generator 130 creates a binary stream of information, which is output therefrom on data line 132 and clock line 134. The frame generator concatenates a unique deliminator flag, as shown in FIG. *6c*, the information stored in memory 84, as shown in FIG. *6a*, and the information stored in status register 118, as shown in FIG. *6b*, into a string, as shown in FIG. *6d*. To effect this concatenation, the information stored in memory 84 is clocked from output 110 into the frame generator and thereafter reinserted into the memory 84 through input line 108 thereby restoring memory 84 to its original condition.

The bit stream as exemplified in FIG. *6d*, is cyclically repeated until the information in status register 118 is cleared by the alarm condition being corrected. To comply with the regulations of certain communication authorities, the repetition of the bit stream is randomnized. The repeating bit stream is fed down data line 132 with clock pulses being provided on line 134. Sync pulse generator 136 adds a synchronizing pulse to the bit stream and has an output 138. As representatively shown in FIG. *6e*, each downgoing edge of the wave form serves as a timing edge for the receiver to synchronize with. If a 1 is to be represented in the bit frame, the sync pulse generator generates a high level shortly following the down going sync pulse. If a 0 is to be represented, the level does not go high as soon.

The signal on line 138 is then fed to a frequency shift key (FSK) modulator 140. The output from the FSK modulator appears on line 142 and, in accordance with the signal on line 138, varies between 11 kilohertz and 9 kilohertz. This signal is then fed to transmitter 144 which amplitude modulates the signal at a carrier frequency of 300 million hertz. In order to comply with certain communication regulatory authorities, the field strength output by the transmitter should be limited to less than 6,000 microvolts per meter at 3 meters. The transmitter receives a control signal on line 146 from the frame generator to turn the transmitter on only when the frame generator is cyclically repeating the bit stream.

Figure 5:
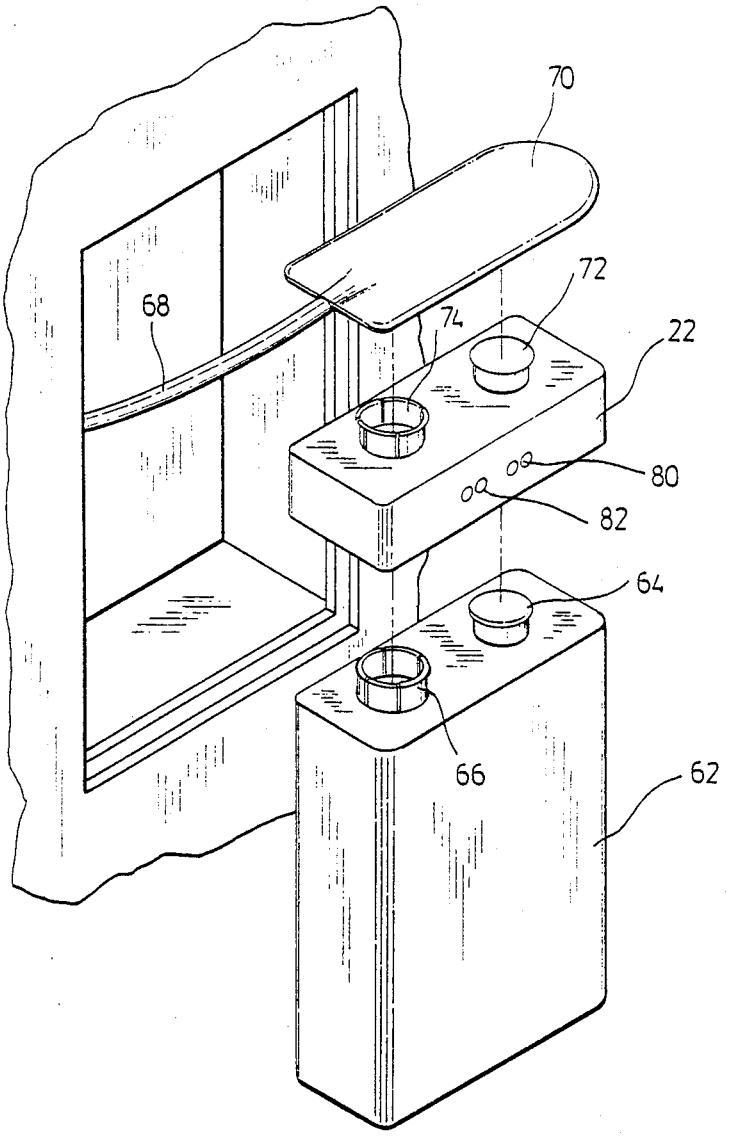
FIG. 5 is a perspective view of the component form of the transmitter which is adapted for insertion between the power supply for and the electrical leads to the particular sensor.

As shown in FIG. 5, a transmitter, such as transmitter 22, is very compact compared to the size of the usual battery power supply 62 for a fire/smoke detector or intrusion detector. The nine volt batery includes the usual male terminal 64 and female terminal 66 which mate with transmitter terminals 94 and 96 as may be seen in FIG. 8. The electrical leads to the sensor are encased in wire coating 68 and, although not shown, the underside of tab 70 includes the male and female terminals which mate with the corresponding terminals on the battery. The transmitter is inserted between the lead 68 to the sensor and the power supply. Thus the transmitter is provided with two sets of male and female terminals 72 and 74. The side of the transmitter includes the connect pin arrangement 80 and 82 which permits connection of the transmitter to the connect coupler 56 of the keyboard to permit loading of information into the memory of the transmitter 22.

With this arrangement, it is apparent that the transmitter may be simply inserted between the power supply and the leads to the sensor without adding substantially to the bulk of the system. This permits users, particularly householders, to insert the transmitter into existing sensor housings without having to alter or replace their existing units.

With reference to FIG. 7, receiver and demodulator 148 receives the signals transmitted by the various transmitters. The modulator uses the down going edges of the pulses introduced by sync pulse generator 136 to decode the received signal and output a signal on line 150 which corresponds with the bit stream produced by frame generator 130 in a particular transmitter. The demodulated signal is then processed by flag recognizer 152 which searches for the unique deliminator flag sequence as illustrated in FIG. *6c*. Upon recognition of this flag bit pattern, the following 25 bits of information are separated from the received stream and passed down line 154 to bit stream comparator 156. The 25 bits of information contain the system identification number, sensor description, sensor location index, sensor location subindex and sensor status transmitted by a particular transmitter. This information is stored in the bit stream comparator 156.

It will be appreciated that many transmitters from either one security alarm system or neighbouring systems may transmit simultaneously and thus result in broadcast congestion and collisions which result in an erroneous signal being received. Since each transmitter in either the security alarm system itself or neighbouring systems transmits synchronously and with periods of random length between the repeated frames, it is necessary to ensure that the information passed on by the flag recognizer 152 is correct. Many erroneous receptions due to overlap will be eliminated by the flag recognizer 152, but the possibility still exists for error in the subsequent 25 bits of information. Since the transmitters randomly repeat the frame of information being transmitted, it is possible to compare several transmissions and determine their correctness. To this effect, bit stream comparator 156 stores the most recent ten bit streams passed on by flag recognizer 152. If a matching pair of bit streams can be found in the most recent ten bit streams received, it is assumed that the transmission is correct. A copy of the matched bit stream is passed down bus 158 to a microprocessor 160 which is the principal part of the central monitor 12.

The microprocessor checks the first seven bits of the bit stream received and determines if the information therein corresponds to the system identification number which has previously been stored in memory 92 of the central monitor 12. If the received system identification number corresponds to the stored system identification number, the remainder of the received information is processed and the correct response initiated. The sensor description, sensor location index and sensor location subindex and sensor status is compared with the information stored in memory 92 and depending upon predetermined criteria, the appropriate alarm or alarms are actuated according to a predetermined response. The alarms include an outside horn 34, a telephone dialer 36, a voice synthesizer 38 and a trouble indicator 40. The home owner is alerted to the sensed alarm condition and appropriate corrective action may then be taken.

Although various preferred embodiments of the invention have been described herein in detail, it will be understood by those skilled in the art that variations may be made thereto without departing from the spirit of the invention or the scope of the appended claims.

The embodiments of the invention in which an exclusive property or privilege is claimed are defined as follows:

1. In a security alarm system having a plurality of sensors for one or more of fire, smoke intrusion, appliance operation and the like, a central monitor for monitoring and preceptibly indicating the status of each of said sensors, individual means for transmitting information from each of said sensors to means associated with said central monitor for receiving and processing such information to indicate perceptibly by said monitor the status of respective sensor causing transmission of such information, individual memory means associated with each respective transmitter means and with said receiver means for storing information which enables said monitor to recognize information transmitted by a transmitter means of said security alarm system as actuated by corresponding sensor and thereby identify the status of such sensor, the improvement comprising a programmable electronic memory having sufficient bits of memory to accommodate the predetermined indentification information to be stored for said individual memory means for each of said transmitter means and said receiver means, electronic means for loading information data into said programmable electronic memory of each said transmitter means and into said programmable electronic memory associated with said receiver means, each transmitter means having electrical coupling means for electrically connecting said transmitter to said electronic means for loading information data, said transmitter means being separable from said electronic means for loading information data after completion of loading the desired identification information data into said electronic memory to preclude altering the information data stored in said memory of each said transmitter means, said central monitor having a programmable miccroprocessor which is adapted to access said programmable electronic memory of said receiver means upon receiving transmitted information from a respective transmitter means to enable said microprocessor to process the received information and provide the corresponding perceptible indication via said monitor.

2. In a security system of claim 1, said data loading means having a keyboard for entering of predetermined information, said data loading means being adapted to process such information and convert it into data which is loaded into a corresponding electronic memory.

3. In a security system of claim 2, said data loading means being a component of said monitor, said monitor having an electrical coupler compatible with said electrical coupler of each transmitter to provide for electrical communication between said respective transmitter means and said data loading means.

4. In a security system of claim 3, said data loading means being adapted to load the information into both of said respective transmitter means memory and said memory associated with said receiver.

5. In a security system of claim 4, said monitor having a programmable microprocessor which is adapted to access the memory for said receiver means upon receiving transmitted information from a respective transmitter means to enable said microprocessor to process the received information and provide the corresponding perceptible indication via said monitor.

6. In a security system of claim 4, said microprocessor being adapted to actuate one or more of an alarm, telephone dialer and sensor status indication light in accordance with the content of the received information from a respective transmitter actuated by the corresponding sensor.

7. In a security system of claim 1, each transmitter means having a temporary power supply to power its electronic memory once the transmitter means is disconnected from said data loading means until said transmitter is coupled with a power supply for said sensor with which said transmitter means is associated.

8. In a security system of claim 1, 3 or 7, each of said transmitter means being a radio wave transmitter and said receiver means being a radiowave receiver.

9. In a security sytem of claim 3, said keyboard being an alpha-numeric keyboard, said monitor having a programmable microprocessor which is adapted to process alpha-numeric information entered via said keyboard and convert such information into binary coded decimal format for storage in the electronic memory of each transmitter means being loaded with its identification information and for storage in the electronic memory for said receiver means to enable said monitor to identify anyone of its transmitter means and the information being transmitted, said data entry in both said transmitter and receiver means memory reducing likelihood of data entry error in coding said system.

* * * * *